United States Patent [19]

Moreau

[11] 4,163,377

[45] Aug. 7, 1979

[54] CONTINUOUS HYDROSTATIC EXTRUSION PROCESS AND APPARATUS

[75] Inventor: Marc Moreau, Asnieres, France

[73] Assignee: Trefimetaux, Argenteuil, France

[21] Appl. No.: 847,098

[22] Filed: Oct. 31, 1977

[30] Foreign Application Priority Data

Dec. 7, 1976 [FR] France ..... 76 37556

Related U.S. Application Data

[60] Continuation-in-part of Ser. No. 740,489, Nov. 10, 1976, Pat. No. 4,111,023, which is a division of Ser. No. 676,908, Apr. 14, 1976, Pat. No. 4,041,745.

[51] Int. Cl.[2] ..... B21C 23/32; B21C 33/00; B21C 23/01; B21C 23/22

[52] U.S. Cl. ..... 72/60; 72/256; 72/258; 72/262; 425/224

[58] Field of Search ..... 72/60, 262, 270, 253, 72/261; 425/223, 224; 264/88, 176 C, 280

[56] References Cited

U.S. PATENT DOCUMENTS

| | | | |
|---|---|---|---|
| 3,667,267 | 6/1972 | Fuchs | 72/270 |
| 3,740,985 | 6/1973 | Fuchs | 72/60 |
| 3,765,216 | 10/1973 | Green | 72/262 |
| 3,911,705 | 10/1975 | Voorhes | 72/270 |
| 3,934,446 | 1/1976 | Avitzur | 72/262 |
| 3,985,011 | 10/1976 | Fuchs, Jr. | 72/60 |
| 4,041,745 | 8/1977 | Moreau | 72/60 |
| 4,044,587 | 8/1977 | Green | 72/262 |
| 4,054,048 | 10/1977 | Hagerman | 72/262 |

FOREIGN PATENT DOCUMENTS

| | | | |
|---|---|---|---|
| 2128843 | 10/1970 | France | 72/262 |
| 2197665 | 10/1972 | France | 72/262 |
| 2029568 | 6/1973 | France | 72/262 |
| 2160413 | 3/1974 | France | 72/262 |

*Primary Examiner*—Francis S. Husar
*Assistant Examiner*—D. M. Gurley
*Attorney, Agent, or Firm*—Dennison, Dennison, Meserole & Pollack

[57] ABSTRACT

The invention concerns a process and apparatus for continuous hydrostatic extrusion wherein the pressure of the hydrostatic fluid is used to apply the blank to be extruded firmly against the walls or the bottom of a groove provided in a rotor, in such a way that the blank is entrained by the rotor without slipping to an extrusion chamber from which the blank is spontaneously extruded through a die. The invention finds use in particular for continuous extrusion of metal and alloys, including those which have a low degree of ductility.

10 Claims, 12 Drawing Figures

CONTINUOUS HYDROSTATIC EXTRUSION PROCESS AND APPARATUS

This is a continuation-in-part of application Ser. No. 740,489, filed Nov. 10, 1976, now U.S. Pat. No. 4,111,023, issued Sept. 5, 1978. Application Ser. No. 740,489, is in turn a division of application Ser. No. 676,908, filed Apr. 14, 1976, now U.S. Pat. No. 4,041,745, issued Aug. 16, 1977. Both prior applications claimed priority of French Application No. 75.15733, filed May 14, 1975.

The present invention concerns a process and apparatus for continuous hydrostatic extrusion, which can be used in particular for metals and alloys.

Conventional methods of cold shaping metal wires of circular cross-section (by wire-drawing) or of any cross-section (essentially by drawing) are very old.

Their disadvantages are well known:

In the case of wire-drawing; to achieve substantial reductions in cross-section from a machine wire which is produced hot, it is necessary to use a whole series of precise, expensive dies, which often suffer rapid wear.

In the case of drawing; it is necessary to use a plurality of passes, to achieve progressive shaping in series of very expensive dies.

Many metals and alloys do not easily withstand these successive treatments and they must be subjected to intermediate treatments (this is the case with brass) and/or surface treatments to limit the degree of wear of the dies (this is the case with stainless steel or titanium).

To overcome these disadvantages, processes have been proposed in which the reduction in cross-section is effected in a single pass, under the action of very high pressures. This is the case in particular with the processes described in French Pat. Nos. 2 128 843 and 2 197 665 in the name of UNITED KINGDOM ATOMIC ENERGY AUTHORITY, and in U.S. Pat. Nos. 3,911,705 in the name of W. G. VORRHES and 3,934,446 in the name of B. AVITZUR.

However, these processes are based on dry metal-to-metal friction, which causes very substantial heating of the apparatus and the treated articles, and this heating can even be such as to begin to cause melting of the latter, while also requiring substantial drive power.

Processes for continuous extrusion, referred to as hydrostatic processes, have also been proposed, in which a blank is forced through a die under the action of a viscous fluid subjected to a very high pressure.

Such processes have many advantages, in particular:

the possibility of achieving very high ratios in respect of reduction in cross-section, even in the case of metals having a low degree of ductility;

the possibility of producing, under such conditions, a metal which has been heavily worked cold, and which is therefore mechanically very strong;

low degree of wear of the tooling;

flow of the metal without dead regions, hence resulting in sound products which are free from core inclusions originating from the surface of the blank.

Such processes have been described in particular in French Pat. Nos. 2 029 568 and 2 160 413 in the name of WESTERN ELECTRIC (respectively corresponding to U.S. Pat. Nos. 3,667,267 and 3,740,985), describing a process which is carried out by means of highly complex apparatus; in French Patent Application No. 75.39401 in the name of TREFIMETAUX, which process is very complicated to perform; and in U.K. Pat. No. 1 430 623 in the name of KOBE STEEL, in which the wire is drawn into the high-pressure chamber by a winch which is disposed in the chamber itself.

This last process is simple to perform if operation is effected at a relatively low pressure, but the ratio in respect of cross-sectional reduction permitted by the use of a single chamber is much too low for cold working the majority of metals. The use of multiple chambers arranged in series then results in an equipment design which is extremely heavy and expensive, bearing in mind the pressures involved.

At the present time, in spite of the high level of interest which it generates, no continuous hydrostatic extrusion process has been satisfactorily performed and put into operation, on an industrial basis.

The practical difficulty encountered hitherto by research concerning continuous hydrostatic extrusion processes lies essentially in the continuous introduction of a product of indefinite length into a chamber containing a fluid under very high pressure. Extrusion of the product through a die which opens out of the chamber is then effected spontaneously.

Applicant has discovered a novel process and an apparatus for continuous hydrostatic extrusion, which comprises a chamber containing a fluid under very high pressure, into which the product is introduced continuously by a drive rotor, utilizing the pressure of said fluid to generate an adhesion force between the product and the walls of a groove formed in the rotor, in such a way that there is no relative slipping in the direction of the drive motion, between the object to be extruded and the rotor.

The invention will be better understood from the following embodiments and drawings:

FIGS. 1, 2 and 3 relate to the principle of the invention;

Figure 4:
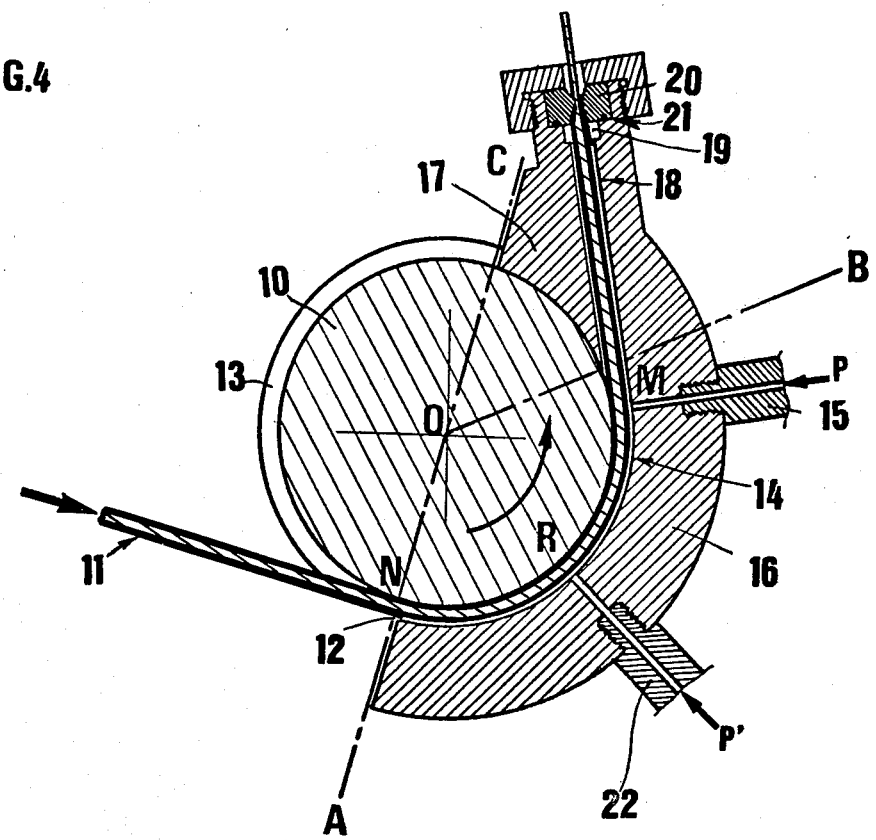
FIGS. 4 and 5 show an embodiment of the invention in which the groove is provided at the periphery of the rotor.
Figure 5:
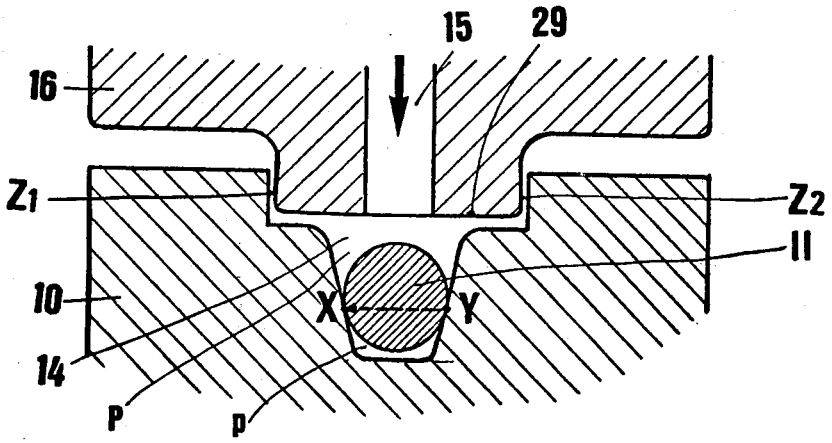
Figure 6:
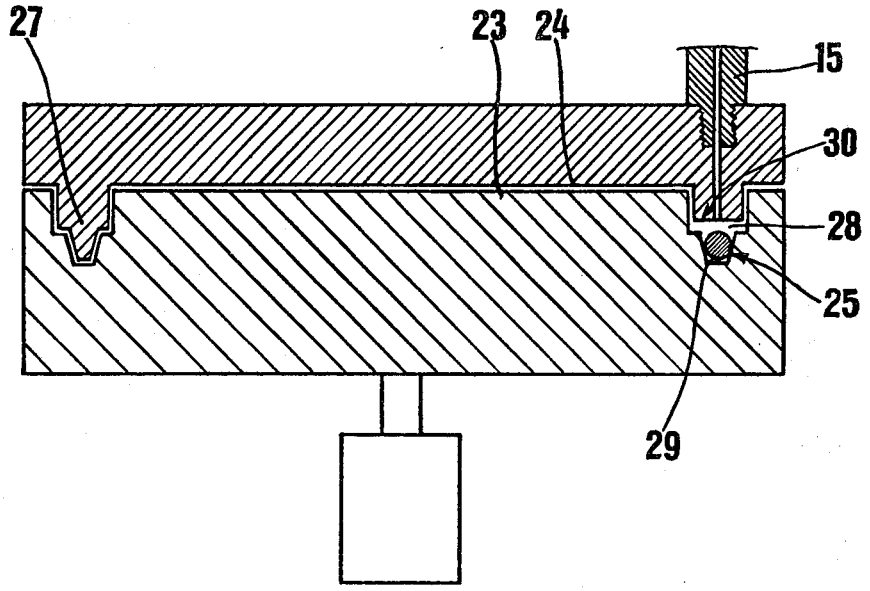
FIGS. 6 and 7 show another embodiment in which the groove is provided on the face of the rotor which is towards the stator, the stator forming a cover.
Figure 7:
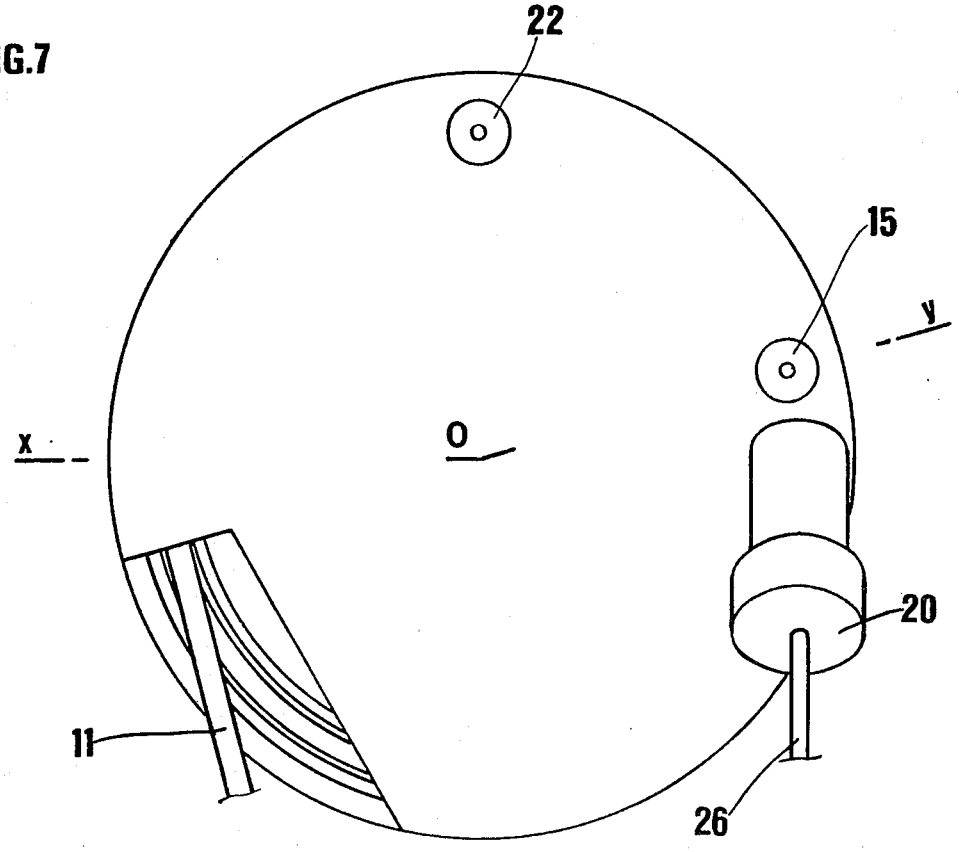
Figure 11:
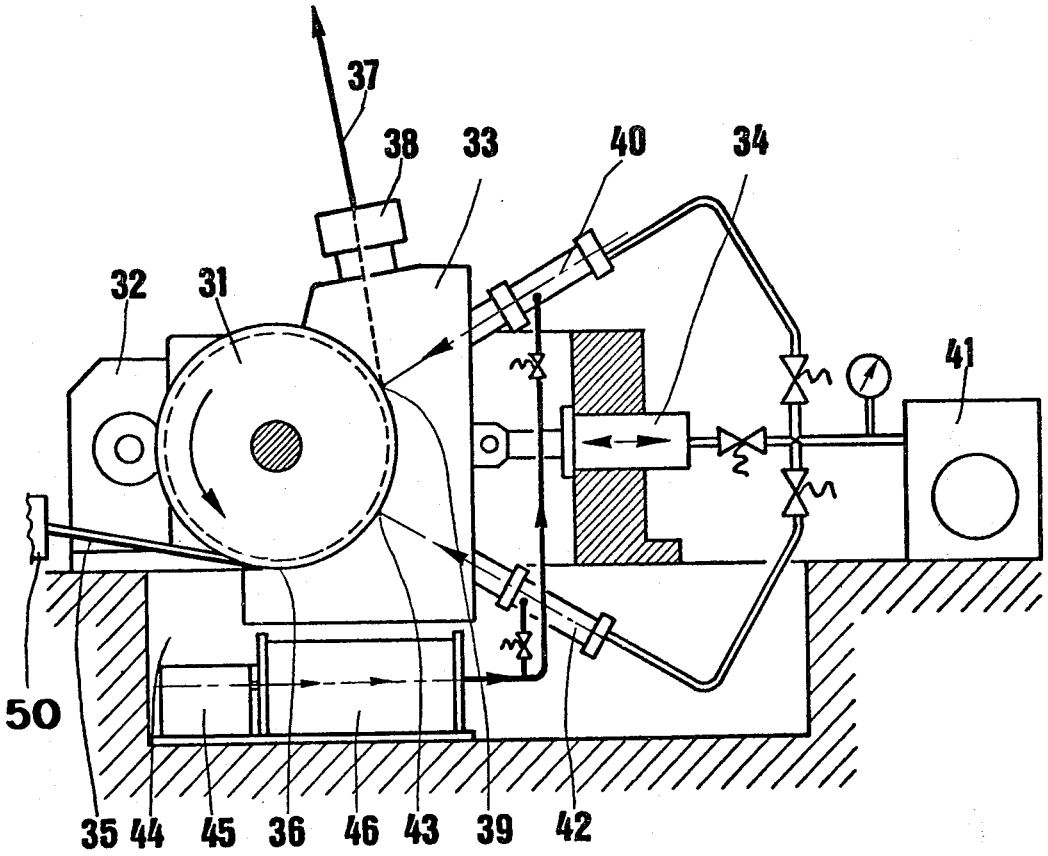
Figure 12:
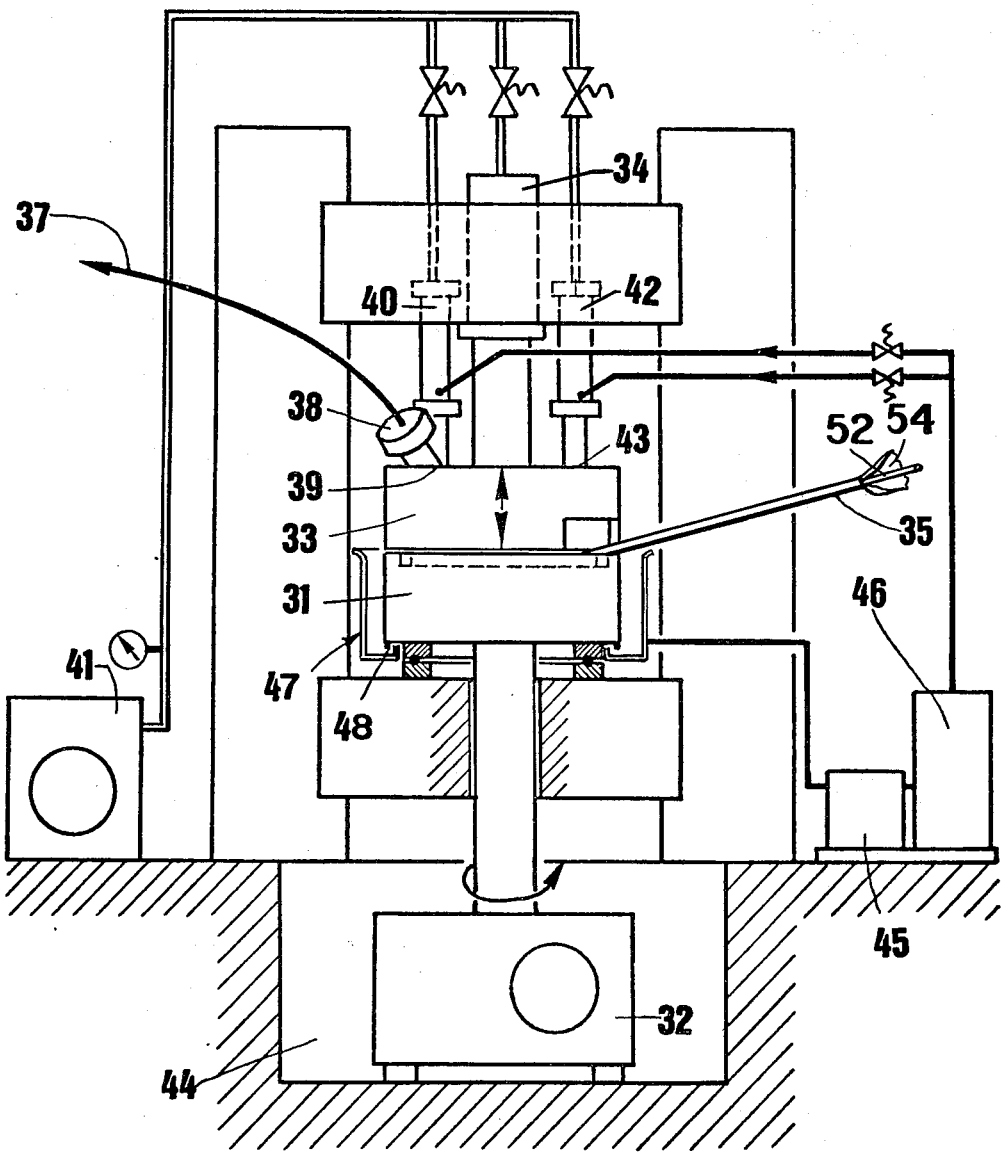

FIGS. 11 and 12 diagrammatically show two complete installations for continuous hydrostatic extrusion, according to the invention, including the accompanying equipment, in the case where the stator encases the rotor (FIG. 11), using the principle of FIGS. 4 and 5, and the case where the stator is in the form of a flat cover (FIG. 12), using the principle of FIGS. 6 and 7.

Figure 2:
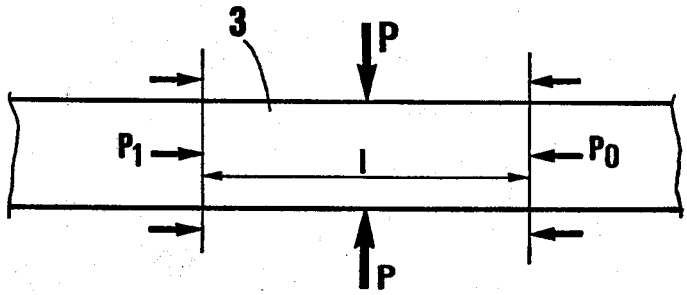
Figure 3:
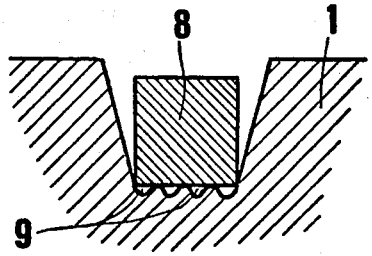

The principle of this process will first be explained with reference to FIGS. 1, 2 and 3.

Figure 1:
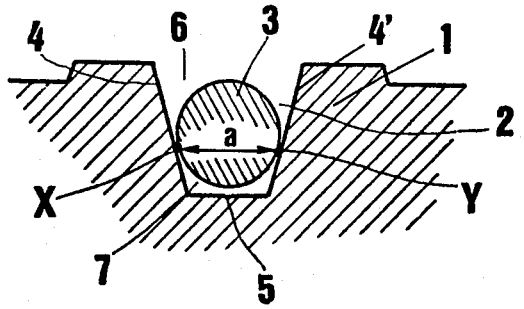

We shall first consider a rotor 1 in which there is provided a groove 2, following a circular path thereabout, which is illustrated in cross-section in FIG. 1, and an object 3 to be extruded, which is placed in the groove so as to come into contact either with the two side walls 4 and 4' or the bottom 5 of the groove, or the side walls and the bottom; the pressure P of a viscous fluid is applied to the upper part of the object.

The object 3, which is shown as having a circular cross-section but which can be of any other cross-sectional shape, is applied against the walls of the groove at the location of the two generating lines, at points such as X and Y. In the bottom 7 of the groove there is a pressure which is at all points lower than or, locally, at most equal to the pressure P, and which may be equal to ambient pressure if the bottom 7 of the groove is in communication with the free air.

The object to be extruded therefore divides the groove into two zones, an outward zone 6 in which there is a pressure P and an inward zone 7 which there is a pressure p.

The pressure P varies progressively along the groove. If we consider a portion of length l, of the object 3 to be extruded, the mean pressure upstream of l is equal to Po, and the mean pressure downstream of l is equal to Pl, the terms upstream and downstream being determined by reference to the direction of movement which is to be imparted to the object 3 in the direction of the extrusion chamber. The above-mentioned portion of the object 3 is subjected to the four pressures P, p, Po, and Pl, as can be seen from FIG. 2. These pressures generate forces applied to the portion l.

The condition under which the portion is driven by the rotor without slipping is that the gripping force of the object in the groove is at least equal to the resisting force due to the gradient of the pressure P, this force tending to cause the above-mentioned portion to slip in a downstream direction. This condition can be written, while neglecting in particular the influence of the inherent mechanical strength of the object:

$$(P-p)l\times a\times k>(Pl-Po)s,$$

or:

$$P-p \geqq (Pl-Po)\times\frac{s}{l\times a\times k}$$

in which equation:

P is the mean pressure in the outward zone of the groove 2 above the object 3, p is the mean pressure in the inward zone of the groove 2 below the object 3, Po is the mean pressure in the section of the groove 2 at the upstream end of the portion of the object in question, Pl is the mean pressure in the section of the groove 2 at the downstream end of the above-mentioned portion, l is the length of the above-mentioned portion, a is the width of the groove in the region in which the object separates it into an outward zone 6 and an inward zone 7, s is the cross-section of the object, k is an adhesion coefficient dependent on the shape and nature of the surfaces in contact.

If for example we consider a portion of metal wire of substantially circular cross-section, being 10 mm in diameter and 5 cm in length, we have:

$$l=5\times10^{-2}\ m$$

$$a\simeq10^{-2}\ m$$

$$s\simeq0.8\times10^{-4}\ m^2$$

From the experience acquired in respect of hydrostatic extrusion, we can assume:

$$Po=5000\times10^5 \text{ Pascal (5000 bars)}$$

$$Pl=6000\times10^5 \text{ Pascal (6000 bars)}$$

$$k=0.1$$

The equilibrium condition can be set out as follows:

$$P-p \geqq (Pl-Po)-\frac{s}{l\times a\times k}$$

$$P-p \geqq 1000\times10^5\times\frac{0.8}{5\times0.1}$$

$$P-p \geqq 1600\times10^5 \text{ Pascal (1600 bars)}$$

This condition can be very easily realised.

The same considerations apply where the object to be extruded is of a different cross-sectional shape from the circular shape mentioned above, for example a square or rectangular section 8. The inward zone 7 in which there is the low pressure p is, as shown in FIG. 3, in the form of passages 9 formed in the bottom of the groove 2.

Therefore, in these different cases, it is possible for an object which is taken at ambient pressure to be entrained without slip by means of a rotor, and introduced into an extrusion chamber containing a fluid at a very high pressure.

The present invention which is based on the use of the above-mentioned considerations is thus distinguished from the known processes in which the entrainment of the blank involves very substantial metal-to-metal frictional effects.

The continuous hydrostatic extrusion process, according to the invention, comprises introducing a blank of indefinite length, accompanied by a substantial amount of a viscous fluid, into a groove provided in a drive rotor, in which said blank defines two separate concentric zones, the first zone being on the outward side and being towards a stator which forms a cover applied to the rotor. The first zone directly receives the viscous fluid under high pressure by an introduction means generating a pressure which progressively increases from the entry point, at ambient pressure, to the chamber in which the extrusion pressure is obtained, which pressure is generally higher than that obtained in the second zone which is on the inward side, at the bottom of the groove. The pressure difference applies to the blank a force which tends to press it into the groove and which produces a sufficient degree of grip for the movement of the rotor to entrain the blank without slipping, from the upstream region at ambient pressure, in a downstream direction to the entry of a high-pressure chamber from which the blank issues by extrusion through a die, which may be simple or multiple, fixed or removable, and in one or more parts.

The apparatus for continuous hydrostatic extrusion, for carrying out the process, which apparatus is also according to the invention, comprises two co-operating coaxial members, one being a movable member, referred to as a rotor, and carrying at its surface a groove of revolution which is adapted to the form of the blank to be extruded. The other member, referred to as the stator, is fixed and forms a cover over a first sector of the groove containing the blank and a viscous fluid, which is substantially sealed with respect to said fluid. The stator includes, in a second sector of the groove disposed downstream of the first sector, a relief portion which totally blocks the section of the groove and which is precisely adapted thereto, to make it sufficiently sealed relative to the viscous fluid. The stator further includes a means for supplying the groove with viscous fluid under high pressure from a pressure generator which can be of known type, and an aperture disposed opposite the first sector of the groove, in the vicinity of the second sector, the aperture opening by way of an elongate conduit which passes through the stator, into an extrusion chamber which communicates with the exterior through at least one die, the viscous fluid supply means producing in the first sector of the groove a pressure gradient from the point of entry, at ambient pressure, to the entry of the conduit which opens into the chamber in which the extrusion pressure is obtained.

The pressure build-up or pressure gradient is developed in the viscous fluid by the rotary movement of the rotor. The pressure increases along the groove by the fluid, because of its viscosity, being carried in the direction of the die without the possibility of escape, except for very minor leakages between the rotor and stator, and by the passage of a thin lubricating film through the die on the extruded product. These leakages are compensated for by a continuous injection of the viscous fluid. The pressure build-up, applied only to the upper part of the blank, forces the blank against the walls and/or bottom of the groove whereby there is no relative slipping therebetween.

Referring to FIG. 4 which is a view in cross-section taken perpendicularly to the axis 0 of the rotor 10, the object 11 to be extruded enters, at 12 at point N, the first sector of the groove 13 provided in the rotor 10. The first sector extends approximately between the radii OA and OB. At point N, the above-defined pressures P and p are equal to ambient pressure. The viscous fluid, under the extrusion pressure, is introduced into the first concentric zone 14 by means of the delivery conduit 15 which passes through the stator 16. In the second sector which is between the radii OB and OC, the groove 13 is blocked by a relief portion 17 of the stator 16, so as to be substantially fluid-tight with respect to the viscous fluid.

When the process is started, the blank 11 must be engaged into the elongate conduit 18, in the extrusion chamber 19, and at the entry of the die 20; the term extrusion chamber denotes the part of the conduit 18 which is immediately upstream of the die 20. The extrusion chamber can be of a shape and dimensions which are identical to or very different from those of the elongate conduit 18, without this affecting the extrusion procedure.

The die is fluid-tightly secured to the end of the conduit 18, by means of the seal 21; in this way, the pressure of the fluid is constant over the whole length of the conduit 18 and in the extrusion chamber 19, and is equal to $P_{EX}$.

It is possible to provide one or more delivery conduits for injection of the viscous fluid at a pressure P' which is intermediate between the ambient pressure and the high pressure $P_{EX}$, such as the delivery conduit 22.

FIG. 5 is a view in cross-section in a plane passing through the axis 0 at the location of the delivery conduit 15. The clearance shown between the rotor and the stator in the sealing zones $Z_1$, $Z_2$ is greater than the clearance will be in an actual construction, for the sake of clarity of the drawings. In practice, this clearance will be measured in tenths of a millimeter. This also applies to all the following Figures.

FIG. 6 shows a cross-sectional view of another embodiment of the invention, in which the rotor and the stator no longer co-operate by way of their external and internal peripheries respectively, but by way of their faces 23 and 24 which are perpendicular to the axis of rotation.

The groove 25 is provided in the face 23 of the rotor which co-operates with the face 24 of the stator.

The right-hand part of FIG. 6, relative to the axis of rotation, is a half-section through the viscous fluid injection passage 15 disposed at the downstream end of the first sector of the groove, whereas the left-hand part is a half-section through relief portion 27 which blocks the groove 25 in its second sector. Pressure P is obtained in the outward zone 28, and pressure p is obtained in the inward zone 29.

FIG. 7 shows a view from above, in a plane perpendicular to the axis of rotation, of the apparatus of FIG. 6. The blank 11 enters the groove of the rotor, on the left-hand side, and issues from the die 20 in the form of the wire-drawn product 26.

Figure 8:
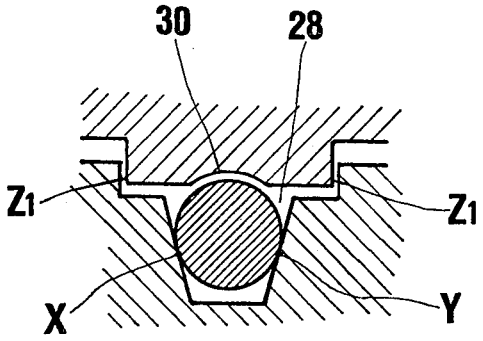
FIG. 8 shows a particular form of the cover, in the part which is towards the blank, the cover being adapted to the shape of the blank.
Figure 10:
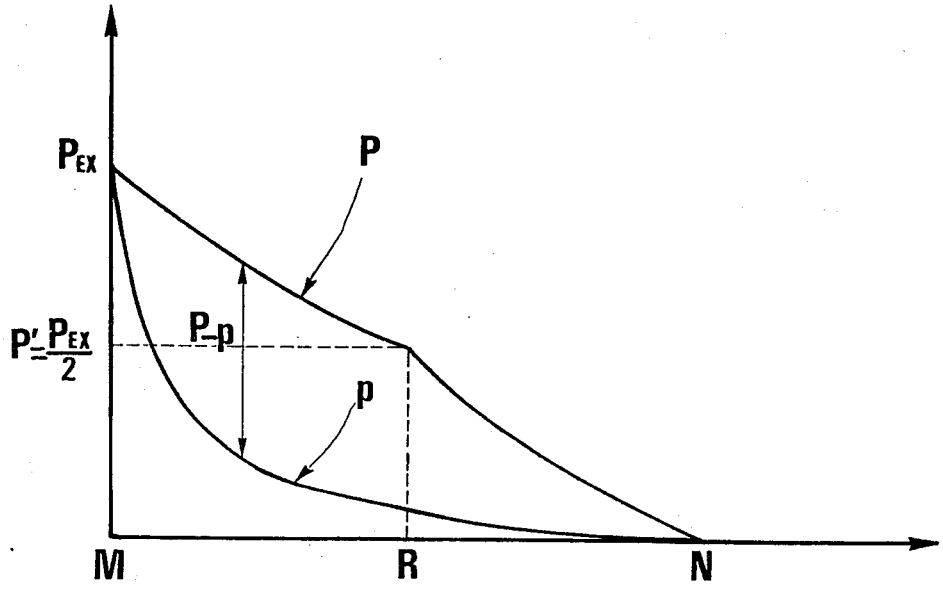
FIG. 10 shows the distribution of the pressures on the blank along the first sector of the groove.

Both in the embodiment of FIGS. 4 and 5 and the embodiment of FIGS. 6, 7 and 8, the difference P−p depends on the value of the pressure injected into the outward zone of the groove, the distribution of the injection points, if there are multiple injection points, and on the cross-section and the shape of the inward and outward zones of the groove. FIG. 10 shows the distribution of the pressures P and p in a particular case comprising two fluid intakes, one at M (FIG. 4) at the extrusion pressure $P_{EX}$, and the other at R at the pressure $P'_{EX} \simeq P/2$. The point M corresponds to the orifice for the injection of the viscous fluid at high pressure $P_{EX}$ at the downstream end of the first sector of the groove. The point N corresponds to the entry of the object to be extruded into the groove, at the upstream end of its first sector. The point R corresponds to the orifice for injection of the viscous fluid at the pressure $P' = P_{EX}/2$.

It is noted that the difference P−p is always relatively large, except at the point N at which P=p=the ambient pressure, and at point M at which equality as between P and p is necessary to permit the object to issue from the groove in order to pass into the orifice or conduit 18 towards the extrusion chamber 19. This equality can be achieved, as suggested in FIG. 4, by providing that the conduit 18 be cylindrical with a circular cross-section slightly larger than the cross-section of the object 11 so as to enable the object 11 to be fully surrounded by the pressurized fluid.

It is noted that the curve P has radii of curvature which are less pronounced than the curve p. This is because the section of the axial leakage passage formed by the outward zone of the groove increases in a downstream direction. It is possible to seek to achieve this phenomenon by suitable machining of the stator, but it tends to appear spontaneously because of resilient yielding of the walls of the passage under the effect of the thrust forces applied by the viscous fluid. Conversely, the inward passage section tends to decrease in a downstream direction, because of the compacting of the blank at the bottom of the groove.

In the case of FIGS. 4 to 7, it is possible to adapt the shape of the end 30 of the part of the cover which is towards the first sector of the groove, as can be seen in FIG. 8, in such a way as to reduce the transverse section of the zone 28; this substantially reduces the fluid leakage flow rate in the opposite direction to the forward movement of the object to be extruded.

Figure 9:
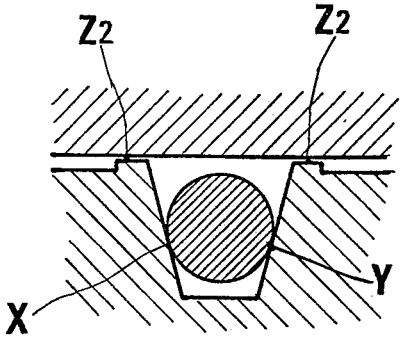
FIG. 9 shows a simplified form of the cover.

On the other hand, it is possible to simplify the design of the stator, as shown in FIG. 9 in which the sealing zones are localized, for example at $Z_2$.

The two possibilities may be combined.

The total leakage of the system is compensated by pumping means which reinject the viscous fluid which has escaped through the different clearances between the rotor, the stator, and the object to be extruded, possibly after purification, filtration and temperature adjustment of the fluid. The abovementioned clearances are essential for normal operation of the apparatus, but they should be reduced to a minimum in known manner, so that the power absorbed by the pumping means is not excessive. For the same purpose, the hydraulic fluid must be of relatively high viscosity.

FIG. 11 diagrammatically shows a view in vertical section of a complete hydrostatic extrusion installation according to the invention, in the embodiment described with reference to FIGS. 4 and 5. The rotor 31 is rotated by a motor-reducing drive unit 32. The stator 33 is brought into and held in its working position by the jack 34. The blank 35 passes into the extrusion apparatus at 36 and the extruded wire 37 issues from the die 38. The viscous fluid at the high pressure $P_{EX}$ is injected at 39, at the downstream end of the first sector of the groove in the rotor, by a tandem pressure multiplying means 40 which is itself fed with fluid by a medium pressure pump 41.

A second tandem pressure multiplying means 42 supplies fluid to an intermediate injection point 43 at a pressure P' which is lower than pressure $P_{EX}$, as described above; the multiplying means 42 is also supplied with fluid from the pump 41.

The whole of the apparatus is mounted above a drain pit 44 into which flows the viscous fluid issuing from the various leakage points and which may be provided with an apparatus of known type for controlling the temperature of the leakage fluid. The viscous fluid is picked up by the low pressure pump 45 and, after filtration, passed to the low pressure accumulator 46 from which the multiplying means 40 and 42 are force fed with fluid.

The jack 34 which controls the positioning of the stator 33 and its contact against the rotor is supplied with fluid from the same source as the pressure multiplying means. For this reason, the force holding the stator 33 against the rotor 31 is proportional to the extrusion pressure, and this provides for correct compensation of the force tending to separate the rotor and the stator.

FIG. 12 diagrammatically shows a view in vertical section of another complete hydrostatic extrusion installation according to the invention. In FIG. 12, the components which perform the same functions are denoted by the same reference numerals as in FIG. 11. The extrusion system itself is of the type described with reference to FIGS. 6 and 7. Leakage fluid is collected in a tank 47 provided with a baffle arrangement 48 and provided with a known device for temperature control (not shown); the leakage fluid is picked up by the low pressure pump 45 and passed into an accumulator 46.

EXAMPLE OF OPERATION:

A continuous hydrostatic extrusion installation was constructed in accordance with the diagrammatic view of FIG. 11 and on the principle illustrated in FIGS. 4 and 5, this installation having a rotor of a diameter of 500 mm (measured at the bottom of the groove) and being supplied with a synthetic polyoxyethylene-base oil with a viscosity of 500 stokes at 20° C.

In a first test, a 10 mm diameter blank of unalloyed copper was introduced, and the apparatus was supplied with viscous fluid at an extrusion pressure of about 16 kbars. The discharge die was 1.6 mm in diameter.

The speed of rotation of the rotor was controlled to 34 r.p.m., corresponding to a blank intake speed of 0.9 meters per second, and an extruded wire discharge speed, the wire having a diameter of 1.6 mm, of 35 meters per second.

During operation, the mean leakage flow rate of the viscous fluid was 30 milliliters per second. This mode of operation produced a wire whose surface had no defect and which was totally free from inclusion.

In a second test, a 10 mm blank of brass known as "UZ 15" (containing 15% of zinc) was introduced into the apparatus. The cross-sectional reduction ratio was fixed at 3 (entry section $s=78.5$ mm$^2$, discharge section $s=25.5$ mm$^2$, rectangular shaped member measuring about $8.5\times3$ mm). The speed of rotation was set at 34 r.p.m., the blank entry speed was 0.9 meters per second, and the discharge speed of the extruded shaped member was 2.8 meters per second. The viscous fluid was introduced at a pressure of about 8 kbars and the leakage flow rate was of the order of 25 milliliters per second. The extruded wire had an excellent surface condition and had neither inclusion nor traces of oxidation. The mechanical properties of the wire corresponded to those of a cold worked metal.

Among the advantages of the above-described invention, in comparison with hydrostatic extrusion processes and in particular that of French Patent Application No. 75.15733 (Trefimetaux), corresponding to U.S. Pat. Nos. 4,041,745 and 4,111,023, are the following:

The die is disposed outside of the groove, which makes it possible to determine its optimum external dimensions and shape, without being limited by the dimensions required for the groove, while also making fitting and removal of the die convenient.

Entraining the blank by the rotor without slip makes it possible to develop a drive force for a very substantial length unit and in practice to use a drive rotor of reduced size (for example a diameter of 500 mm instead of a diameter of 2000 mm in French Patent Application No. 75.15733, in the case of a 10 mm diameter blank). The hydrostatic extrusion process and apparatus described above are suitable both for extruding metals and alloys, even those with a low degree of ductility, and for extruding various materials such as plastics. They can be used over a wide range of temperatures, depending on the nature of the material extruded, the viscous fluid and the tools.

The invention is not limited to the examples and embodiments which have been described above.

For various reasons, in particular better balancing of the hydraulic forces involved, or an increase or diversification in production, it is possible in the installations described with reference to FIGS. 11 and 12 to use, simultaneously or alternatively, a plurality of apparatus according to the invention, which use certain components in common, for example the high pressure generators or the rotor; the rotor may comprise a groove covered by a cover comprising a plurality of members acting as a stator, or even a plurality of grooves, which may be identical or different and which are each covered by a cover comprising one or more members acting as a stator. In this way it is possible to extrude two or more blanks simultaneously or successively.

In order to improve the dimensional regularity of the blank or to remove therefrom the skin, which is the source of abrasive particles that pollute the viscous fluid, it may be of advantage to subject the blank to at least one shaving or shaping pass before it passes into the groove. The drive force generated by the rotor can be utilized to draw the blank through the shaving or shaping device, which can be of any known type. Such a shaving or shaping device has been diagrammatically illustrated at 50 in FIG. 11.

It is also possible to extrude composite products by co-drawing a plurality of separate articles which are introduced jointly into the groove of the rotor and heavily pressed together as they pass through the extrusion die; for example, as suggested in FIG. 12, it is possible to operate in this way to produce a shaped member of aluminium sheathed with copper from an aluminium core member 52 wrapped around by a sheet of copper 54.

I claim:

1. Apparatus for continuous hydrostatic extrusion of a first object, referred to as a blank, of indefinite length, into the form of a second object, which is also of indefinite length but of different section; the apparatus comprising two co-operating coaxial members, one being a movable member, referred to as a rotor, and carrying at its surface a groove of revolution, defined by a pair of opposed side walls and a bottom, which is adapted to receive the blank to be extruded in contact with at least two of said walls and bottom to define separate outward and inward zones respectively above and below the points of contact with said two of said walls and bottom, the other member being fixed, referred to as a stator, and forming, over a first sector of the groove to contain the blank and a viscous fluid, a cover which is substantially sealed with respect to fluid, the stator also comprising, over a second sector of the groove disposed downstream of the first sector, a relief portion which totally blocks the section of the groove and which is precisely adapted thereto to seal the section of the groove relative to the viscous fluid, means for supplying solely the outward zone of the groove with viscous fluid under high pressure from a pressure generator which can be of known type, and an aperture disposed in the stator opposite the first sector of the groove, in the vicinity of the second sector, the aperture opening by way of an elongate conduit which passes through the stator, into an extrusion chamber which communicates with the exterior through at least one die orifice, the viscous fluid supply means producing in the first sector of the groove a pressure gradient from a point of entry for the blank, at ambient pressure, to the conduit which opens into the chamber in which the extrusion pressure exists.

2. Apparatus according to claim 1, wherein the extrusion is effected through a removable die accessible from the exterior of the stator.

3. Apparatus according to claim 1 wherein the opposed sides of the groove taper inwardly toward each other in a direction inward from the outward zone to the bottom.

4. A process for the continuous hydrostatic extrusion of a first object, referred to as a blank, of indefinite length, into the form of a second object which is also of indefinite length but different section, comprising the steps of introducing the blank, accompanied by a substantial amount of a viscous fluid, into a groove provided in a drive rotor wherein said blank defines two separate concentric zones, the first zone being on the outward side and being towards a stator which forms a cover applied to the rotor, said first zone directly receiving the viscous fluid under high pressure by an introduction means and generating a pressure which progressively increases from the entry point at ambient pressure, to a chamber in which the extrusion pressure is obtained, the pressure of the viscous fluid received in the first zone being generally higher than that obtained in the second zone, which is on the inward side at the bottom of the groove, this pressure difference applying to the blank a force which tends to press it into the groove and which produces a sufficient degree of grip for the movement of the rotor to entrain the blank without slipping, from the upstream region, at ambient pressure, in a downstream direction to the entry of a high-pressure chamber from which the blank issues by extrusion through at least one die orifice.

5. A continuous hydrostatic extrusion process according to claim 4, including introducing the viscous fluid into the groove by at least one aperture in the stator, under a high pressure generated by a generator of known type.

6. A continuous hydrostatic extrusion process according to claim 5, wherein the viscous fluid, issuing from the apparatus by way of different leakage points downstream of the entry point, is recovered and reintroduced under high pressure by the introduction means.

7. A continuous hydrostatic extrusion process according to claim 4, including subjecting the blank to at least one shaving pass, before entering the groove of the rotor.

8. A continuous hydrostatic extrusion process according to claim 4, including subjecting the blank to at least one shaping pass, before entering the groove in the rotor.

9. A continuous hydrostatic extrusion process according to claim 4, wherein the viscous fluid, issuing from the apparatus by way of different leakage points downstream of the entry point, is recovered and reintroduced under high pressure by the introduction means.

10. A continuous hydrostatic extrusion process according to claim 4, wherein the blank comprises a plurality of separate members which are introduced jointly into the groove of the rotor and which are heavily pressed together in their passage through the extrusion die orifice.

* * * * *